US005974975A

United States Patent [19]

Seefried

[11] Patent Number: 5,974,975

[45] Date of Patent: Nov. 2, 1999

[54] CLEANING DEVICE FOR CYLINDERS OF PRINTING PRESSES

[75] Inventor: Karl-Heinz Seefried, Zuzenhausen, Germany

[73] Assignee: Heidelberger Druckmaschinen, Aktiengesellschaft, Germany

[21] Appl. No.: 09/208,667

[22] Filed: Dec. 10, 1998

[30] Foreign Application Priority Data

Dec. 10, 1997 [DE] Germany ..... 197 54 822

[51] Int. Cl.[6] ..... B41F 35/00

[52] U.S. Cl. ..... 101/424; 101/425; 15/256.52; 15/179

[58] Field of Search ..... 101/424, 423, 101/425; 15/256.52, 256.51, 256.5, 249.1, 179

[56] References Cited

U.S. PATENT DOCUMENTS

| | | | |
|---|---|---|---|
| 150,725 | 5/1874 | Spaulding | 101/423 |
| 2,879,534 | 3/1959 | Swanson et al. | 15/179 |
| 3,186,019 | 6/1965 | Hattori | 15/179 |
| 3,237,233 | 3/1966 | Adams | 15/179 |
| 4,361,922 | 12/1982 | Karal | 15/256.52 |
| 5,010,819 | 4/1991 | Uribe et al. | 101/425 |
| 5,207,160 | 5/1993 | Harada | 101/423 |
| 5,638,568 | 6/1997 | Dumler et al. | 15/179 |

*Primary Examiner*—Edgar Burr
*Assistant Examiner*—Anthony H. Nguyen
*Attorney, Agent, or Firm*—Herbert L. Lerner; Laurence A. Greenberg

[57] ABSTRACT

A cleaning device for cylinders of printing presses, having at least one wash roll engageable with and disengageable from the cylinders, the wash roll being formed as a brush roll and being sprayable with cleaning fluid, includes straight bristles and wavy bristles arrayed on the brush roll.

5 Claims, 1 Drawing Sheet

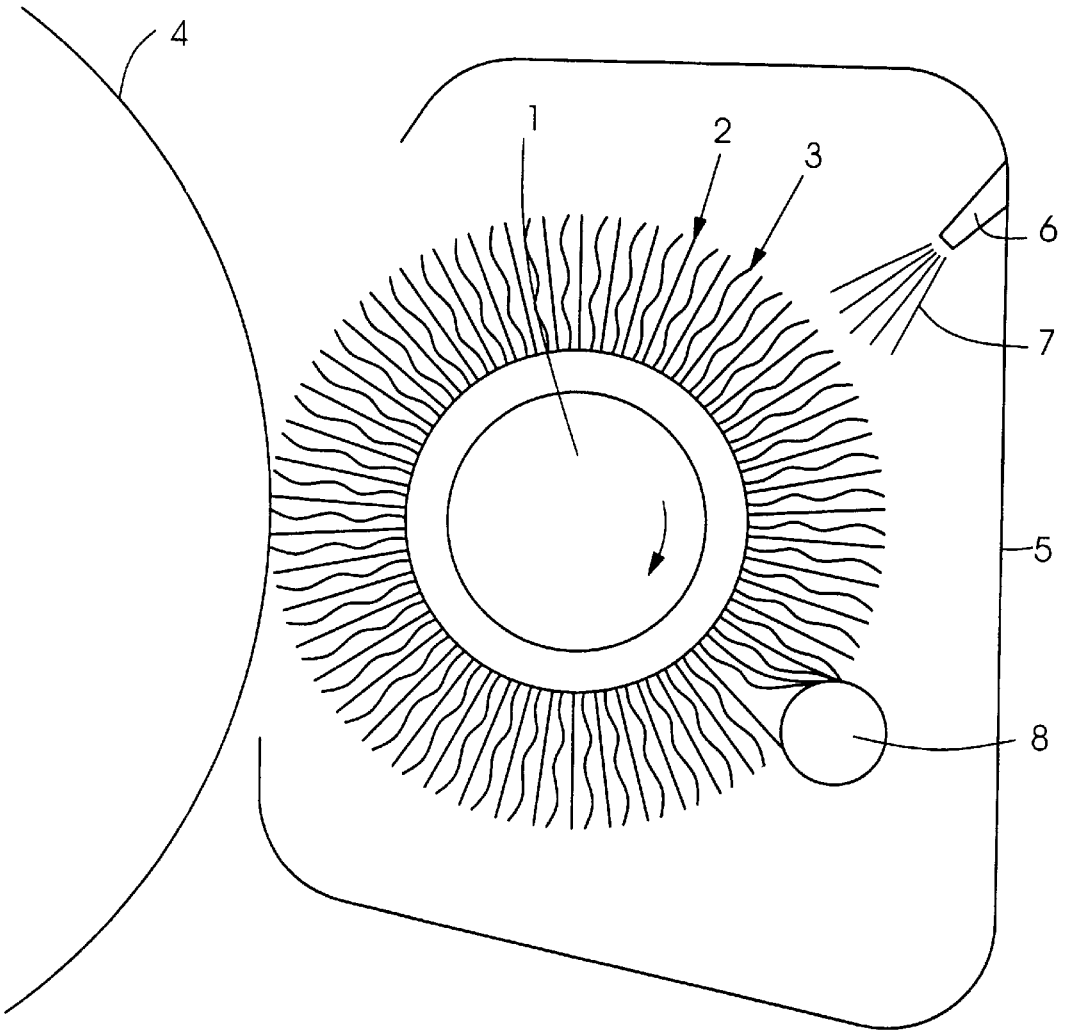
4
1
2
3
6
7
5
8

CLEANING DEVICE FOR CYLINDERS OF PRINTING PRESSES

BACKGROUND OF THE INVENTION

FIELD OF THE INVENTION

The invention relates to a cleaning device for cylinders of printing presses, having at least one wash roller engageable with and disengageable from the cylinders, the wash roller being formed as a brush roller and being sprayable with cleaning fluid.

A heretofore known device of this general type (published German Patent Document DE 43 43 692 A1) uses a brush roller which is disposed in a housing. Cleaning fluid or water may be applied to the bristles of the brush roll via nozzles. In order to clean the cylinder outer surface, the brush roll is pivoted toward the outer surface and set rotating. The feeding of cleaning agent takes place at the same time, so that cleaning agent is applied to the outer surface of the cylinder to be cleaned, and loosens dirt and ink residues thereat. The bristles of the brush roll take up the loosened dirt particles and, downline of a doctor device, throw off the particles into the housing, from which they are then able to run off. It has been shown that, at relatively high speed, the straight bristles of the conventional brush rolls very quickly spray off the cleaning fluid applied and, due to the open surface, have a very low storage capacity for the cleaning fluid. Consequently, only a small fraction of the cleaning fluid which is applied reaches the outer surface to be cleaned. At the same time, the straight bristles are not well suited to take off dirt particles, because of the low adhesive capacity thereof. The result of these disadvantages is that there is a relatively high requirement for cleaning agent, and that the time for cleaning of the outer surface is relatively long.

Starting from this state of the prior art, it is an object of the invention of the instant application, to provide a cleaning device for cylinders of printing presses by the use of which the requirement for cleaning fluid and the time needed for the cleaning are reduced. In this regard, it is assumed that the cleaning result meets the requirements, i.e., an equally good cleaning result on the outer casing surface of the cylinder is achieved.

SUMMARY OF THE INVENTION

With the foregoing and other objects in view, there is provided, in accordance with the invention, a cleaning device for cylinders of printing presses, having at least one wash roll engageable with and disengageable from the cylinders, the wash roll being formed as a brush roll and being sprayable with cleaning fluid, comprising straight bristles and wavy bristles arrayed on the brush roll.

In accordance with another feature of the invention, the straight bristles and the wavy bristles are arrayed in a mixed manner on the brush roll.

In accordance with a further feature of the invention, the straight bristles and the wavy bristles are disposed on the brush roll in a proportionate quantity of 50%:50%.

In accordance with an added feature of the invention, the wavy bristles are formed with from four half-waves to four full waves per 1.7 cm of length, and the amplitude of the waves is about 0.5 mm in double-size cylinders.

In accordance with a concomitant feature of the invention, the bristles are formed of polyamide.

By using both straight and wavy bristles, the action of the cleaning roll is significantly improved, because the wavy bristles have a lower throw-off effect, and are better able to take off or pick up the dirt particles from the outer surface of the cylinder to be cleaned. The straight bristles, which have a superior throw-off effect, are better able to throw off the cleaning fluid applied, so that, with the latter, the dirt particles taken by the wavy bristles are also flushed out of the brush roll. Consequently, with a low requirement for cleaning fluid, the loosened dirt is removed more quickly from the outer surface and, due to the straight bristles, the self-cleaning of the brush roll is not impaired. Thus, even when a brush roll constructed in this manner is used, the cleaning time for the outer surface is shortened, so that the downtime for the printing machine can be reduced.

In an advantageous construction of the device according to the invention, straight bristles and wavy bristles are used in a mixed arrangement. It is possible, for example, to use both types of bristles in individual bristle tufts. In this case, it is particularly advantageous if the proportion of straight bristles to wavy bristles is 50% to 50%, or 1:1. It has been shown that, given such a mixture of bristles, very rapid cleaning of the outer surface is possible, without requiring a large amount of cleaning fluid.

In a special construction of the device according to the invention, the wavy bristles are formed with from about four half-waves to four full waves per 1.7 cm of bristle length, and the wave amplitude is about 0.5 mm in double-size cylinders. In this case, it is advantageous if the bristles are formed of polyamide. A roll of this type both takes or picks up, and also gives up dirt and cleaning fluid well, and has a high wear resistance.

Other features which are considered as characteristic for the invention are set forth in the appended claims.

Although the invention is illustrated and described herein as embodied in a cleaning device for cylinders of printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single figure of the drawing, wherein:

BRIEF DESCRIPTION OF THE DRAWINGS

The single FIGURE is a diagrammatic side elevational view of the cleaning device for cylinders of printing presses, in accordance with the invention.

DESCRIPTION OF THE PREFERRED EMBODIMENTS

Referring now to the single FIGURE of the drawing, there is shown therein a brush roll 1 having straight or rectilinear bristles 2 and wavy bristles 3 arrayed thereon, and being engageable and disengageable with the outer casing surface 4 of a printing-machine cylinder to be cleaned. In the exemplary embodiment shown in the figure, the brush roll 1 is arranged in a housing 5 and can be sprayed with cleaning fluid 7 via nozzles 6. Provided in the lower region of the housing 5 is a doctor-blade bar 8, which serves to hold back the bristles, so that when they snap back they spray off cleaning fluid and dirt particles into the housing 5, with the result that the bristles are freed of dirt particles and contaminated or spent cleaning fluid. Moving the cleaning device towards and into engagement with the outer casing surface 4 of the cylinder, and away from and out of engagement with the outer casing surface 4 can be performed manually or automatically, so that a cleaning cycle can be carried out as required.

I claim:

1. A cleaning device for cylinders of printing presses, having at least one wash roll engageable with and disengageable from the cylinders, the wash roll being formed as a brush roll and being sprayable with cleaning fluid, comprising straight bristles and wavy bristles arrayed on the brush roll.

2. The cleaning device according to claim 1, wherein said straight bristles and said wavy bristles are arrayed in a mixed manner on the brush roll.

3. The cleaning device according to claim 1, wherein said straight bristles and said wavy bristles are disposed on the brush roll in a proportionate quantity of 50%:50%.

4. The cleaning device according to claim 1, wherein said wavy bristles are formed with from four half-waves to four full waves per 1.7 cm of length, and wherein the amplitude of the waves is about 0.5 mm in double-size cylinders.

5. The cleaning device according to claim 1, wherein said bristles are formed of polyamide.

* * * * *